United States Patent [19]

Roberts

[11] Patent Number: 4,813,358

[45] Date of Patent: Mar. 21, 1989

[54] INFLATABLE WAND FOR LOADING A MINING BOREHOLE

[75] Inventor: Brian E. Roberts, Sudbury, Canada

[73] Assignee: IRECO Incorporated, Salt Lake City, Utah

[21] Appl. No.: 200,354

[22] Filed: May 31, 1988

[51] Int. Cl.[4] ..... F42B 3/00

[52] U.S. Cl. ..... 102/313; 102/323; 102/324; 102/333

[58] Field of Search ..... 102/312, 313, 323, 324, 102/331, 333

[56] References Cited

U.S. PATENT DOCUMENTS

| | | | |
|---|---|---|---|
| 4,464,994 | 8/1984 | Porter | 102/333 |
| 4,492,165 | 1/1985 | Marz | 102/313 |
| 4,505,201 | 3/1985 | Abele | 102/324 |
| 4,522,125 | 6/1985 | Marz | 102/313 |
| 4,572,075 | 2/1986 | Day et al. | 102/313 |
| 4,615,752 | 10/1986 | Miller | 102/313 X |

*Primary Examiner*—Peter A. Nelson

*Attorney, Agent, or Firm*—Thorpe, North & Western

[57] ABSTRACT

An inflatable wand for positioning within an upward oriented, mining borehole and near a lower collar opening thereof wherein the wand provides a conduit for introducing and retaining liquid explosive materials within the borehole. The wand includes a flexible tube with longitudinally oriented reinforcing fibers embedded in an elastic composition such as rubber. The tube is constructed to permit radial elongation in response to a force arising within the tube and directed radially outward, but to restrain against axial elongation during use. Such radial elongation arises because of back pressure developed by the flowing explosive as it is impeded at a valve outlet at the distal end of the wand. Enlargement of the wand seals the opening of the borehole without destruction of the elastic material on sharp points and edges of the borehole collar.

23 Claims, 1 Drawing Sheet

INFLATABLE WAND FOR LOADING A MINING BOREHOLE

BACKGROUND OF THE INVENTION

1. Field of Invention

This invention relates to devices utilized to feed liquid explosives into boreholes as part of a mining operation. More particularly, the present invention pertains to a wand which can be positioned near a lower collar opening over the borehole and which operates to seal the opening against outflow of the liquid explosive during loading.

2. Prior Art

The success of underground mineral mining operations depends on efficient fracturing procedures and ore extraction. One form of fracturing operation is referred to as sublevel caving and involves fracturing overhead rock formations in a controlled manner. A complete and continuous fracturing process is important to maximize ore recovery and avoid the high risk of unexpected collapse of overhead rock structure into the sublevel cave area.

The required systematic fracturing of rock structure is accomplished in part by drilling a set of substantially upright, overhead boreholes which are loaded with explosive material. These boreholes may be fan-shaped or parallel in orientation, depending on the desired pattern of collapse of superior rock structure.

The challenge to loading a near-vertical hole from a bottom collar upward is to pump liquid explosive up the length of the hole without allowing the material to drain free of the collar. In the past, mechanical plugs have been used around the insert wand which is positioned within the collar opening. Such plugs are effective; however, they are time-consuming to use and difficult to adapt to all hole configurations. In essence, each mechanical plug must be sized to the differing shape of collar openings. This added time substantially increases the cost of overall mining operations in view of the many boreholes which muswt be filled for a single blasting.

Inflatable wands have been utilized which provide an annular balloon chamber around the flow conduit or wand which inflates with air to seal the surrounding collar opening. Inflation is developed by compressed gas fed to the chamber. This type of inflatable wand requires a rigid conduit to prevent its collapse in response to the inflating air pressure of the balloon chamber. Such rigidity, however, limits the ability of the wand to bend or deform slightly for entry within a collar opening which is angled. It also increases diameter of width requirements of the cavern to at least match the length of the wand to be inserted.

In addition, the prior art gas-inflatable wand requires the use of accessory equipment. This adds capital costs and further time to the loading operation which reduces process efficiency. Eventual removal of the plug also limits selection of explosive materials to those with a high viscosity, a resistance to shear and capacity for integral wall contact to prevent collapse of the loaded explosive with loss of support.

The absence of a more versatile method for sealing the collar opening of the borehole has remained an unsolved problem for many years and resulted in substantial inconvenience and increased costs. A more desirable system would enable the use of a greater variety of explosives, less expensive hardware and the capacity to load quickly and combine the explosive material within the borehole during pumping, blocking venting of material through the collar.

Other unrelated fields of industry have addressed the problem of expandable bladders for use within flow lines but have not provided sufficient relevant teachings or structure to lead to the development of the desired wand or other form of acceptable product. For example, the plumbing industry utilizes an expandable bladder which can be inserted within a pipe. The bladder comprises a simple balloon element connected in line with a pressurized water source and a restrictive nozzle at its end. The device is placed within a pipeline that is clogged and water flow is activated. The restrictive nozzle increases the water pressure within the balloon element, causing it to enlarge and seal the void space at the conduit within the pipe opening. Pressurized water then flows into the flow line and dislodges foreign material therein.

A similar type device is applied within the cement industry for backfilling cracks and subsurface cavities below an existing slab of concrete. The latter device comprises a delivery hose with surrounding air bladder which is inflated to operate as a plug. It is placed within a hole drilled through the slab and the cement is pumped and migrates under pressure to fill void spaces. The air bladder is inflated within the drilled hole to seal it against backflow of the pressurized grout or cement.

Neither of these devices has been successfully applied within the subject mining industry. From a practical viewpoint, this prior art structure is simply not suited to the rigorous environment of a mining operation. In contrast with the smooth interior surface of a pipe or drilled concrete, borehole walls are characterized by irregular sharp points and edges that can quickly cut and tear elastic materials needed for the ballooning effect. To insert the bladder elements of either the plumbing or grouting within the mining borehole interior and to apply pressure would result in expansion, movement and a shredding reaction of the bladder wall against the sharp surfaces of the borehole wall. In other words, the very expansion that is intended to block against liquid backflow, causes bladder rupture.

Such unpredictable response is simply not acceptable when working with large quantities of highly explosive material. As a result, the mining industry continues to rely on use of the mechanical plug or air pressurized device which operates independently of the pressure within the flow line. In each case, the liquid explosive is not involved in expansion of the plug or bladder. It merely passes through the wand and into the borehole interior and column. Backflow and leakage of the liquid is reduced by insertion of plug material or by use of a separate, air-inflated bladder around this flowline conduit.

OBJECTS AND SUMMARY OF THE INVENTION

It is an object of the present invention to provide an inflatable wand which operates in response to back pressure created by the flowing liquid explosive material to seal a base portion of the collar opening against backflow or leakage of liquid explosive.

It is a further object of the present invention to provide an inflatable wand for use witin the borehole which is flexible and allows for the wand to be positioned along an elbow or bend within the borehole interior.

It is a still further object of the present invention to provide an inflatable wand which can be inserted within the mining borehole and inflated to seal the borehole opening, without tearing or seriously damaging the inflatable bladder of the wand.

These and other objects are realized in an inflatable wand for positioning within an upward oriented, mining borehole and near a lower collar opening thereof wherein the wand provides a conduit for introducing and retaining liquid explosive material within the borehole. This wand includes a tube which has a first end and adjacent first terminal section and a second end and adjacent terminal section, with an intermediate section therebetween. The tube is capable of limited radial elongation in response to a force directed radially outward from within the tube. The tube also includes means for restraining against axial elongation during use to avoid damage to the inflating bladder. Means is provided for applying a force directed radially outward from within the tube and for attaching a delivery conduit to the first end to enable supply of the explosive material. Additional improvements and features are set forth in the following detailed disclosure.

Other objects and features of the present invention will be apparent to those skilled in the art based upon the following detailed description, taken in combination with the accompanying drawings.

DETAILED DESCRIPTION OF THE INVENTION

Figure 1:
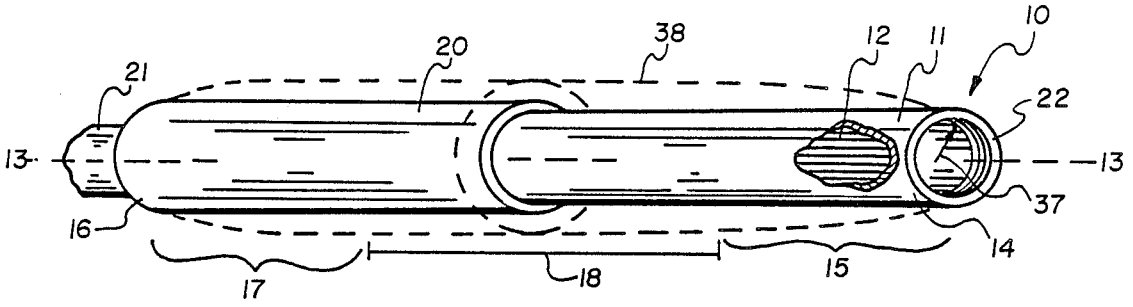
FIG. 1 shows an inflatable wand constructed in accordance with the present invention.

Referring now to the drawings:

FIG. 1 illustrates an inflatable wand 10 constructed in accordance with the present invention. The wand includes an inner conduit 11 which is formed of tire cord or other comparable material having means 12 for restraining the conduit 11 against elongation or movement along the axial 13 direction. This conduit or tube has a first end 14 and adjacent first terminal section 15 extending from the first terminal end. The actual length of the first terminal section 15 will vary and relates to the nature of fiber or reinforcement which is applied along a bias or diagonal with respect to the reinforcement means 12 oriented along the axial direction. This will be discussed in greater detail hereafter.

The tube 11 further includes a second end 16 and an adjacent second terminal section 17 which has similar function and relationship as defined for the first end and terminal sections 14 and 15.

An intermediate section 18 extends between the opposing terminal sections 15 and 17. Here again, the actual length of the intermediate section 18 will vary depending upon the specific design and use of reinforcing fibers along the bias direction. These respective segments 15, 17 and 18 of the tube are relative lengths which assist in defining the actual structure applied within the tube for controlling the extent of radial elongation of the tube 11. These three respective lengths combine to give the full length of desired tubing. For example, a typical length for the entire tube is 91.5 centimeters. Depending on the specific radial expansion desired of the tube 11, lengths of each segment may vary from zero to thirty centimeters for the terminal sections 15 and 17, with the balance of the length being referred to as the intermediate section 18. The outer diameter of tube 11 is selected to be slightly less than the inner diameter of the borehole into whch the inflatable wand is to be inserted. Greater detail will be given on the relative size of the wand with respect to the borehole opening hereafter. Obviously, the size must be less to facilitate insertion of the wand in its non-elongated condition into the borehole opening.

The material used in the preferred embodiment for the subject tube 11 comprises tire cord, meaning the same composition of rubber and reinforcing nylon cord embedded with the rubber of a typical automobile tire. This cord is illustrated as item 12, previously referred to as the restraining means against longitudinal or axial elongation. This reinforcement extends the full length of the tube.

The reinforcing nylon cord 12 develops two important relationships within the tube structure 11. First, the nylon cord 12 precludes significant elongation of the tube body 11 along the axis 13. As has been previously mentioned, such elongation or movement results in tearing or shredding action of the exposed tube surface or other coating material 20 exposed at jagged and sharp rock points at the edges within the borehole. Second, the cord gives added strength and stiffness to the tube to aid in insertion and in the attachment of end fittings.

Stiffness and protection are further enhanced by the exterior coating. Although the use of such an exterior coating is not essential, it is preferred to provide protection to the interior tube 11. This exterior coating 20 may be of any elastic material which can be laminated or attached at the exterior surface of the tube 11 and can be made integral therewith.

The second end of the tube includes means for attaching a supply conduit 21 which provides the source of explosive material to be loaded within the mining borehole. This attachment means may be a threaded fitting or quick attach, clip-on structure which enables a long section of conduit to be attached directly to the body of the wand. An additional fitting 22 is shown in FIG. 1 in its attached position at the first end 14 of the tube. The use of this fitting is discussed hereafter.

Figure 2:
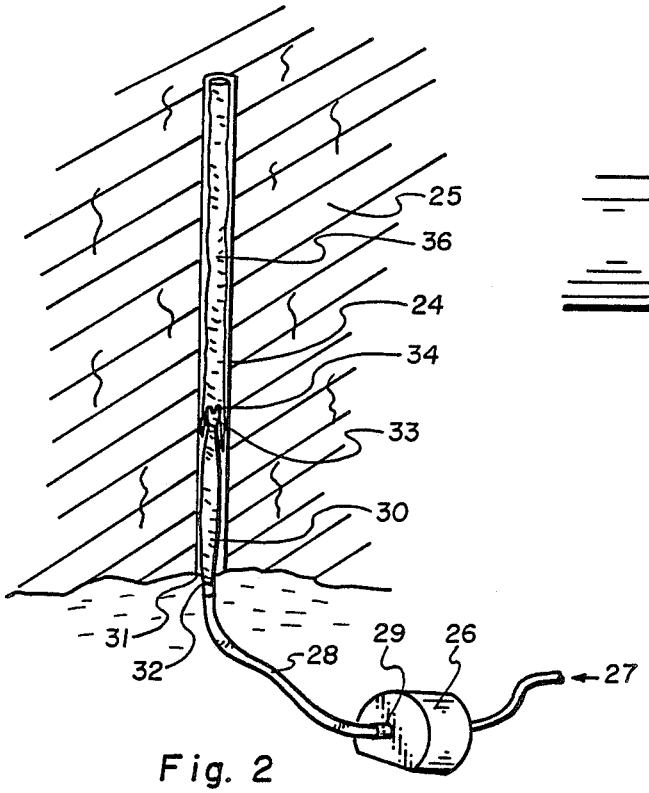
FIG. 2 illustrates the position of the inflatable wand inserted within a mining borehole which has been filled with liquid explosive.

FIG. 2 illustrates an example of a type of use envisioned for the inflatable wand discussed in accordance with the present invention. A borehole 24 has been prepared by conventional techniques such as drilling and extends within a mineral deposit or rock structure 25 in substantial upright orientation. A pumping mechanism 26 has been coupled to a source 27 for liquid explosive material. Such materials include emulsions, slurries and other flowable types of explosive capable of being pumped. Conduit 28 extends from the pump outlet 29 to the attached inflatable wand 30.

This wand 30 is inserted into the lower collar opening 31 of the borehole 24. Although the wand is shown with the second end 32 partially extending free of the collar opening 31, the present invention allows the user the choice of inserting the collar more deeply within the borehole. This may be particularly helpful when the loading procedure is intended to fill the upper portion of the borehole, leaving the lower collar area unaffected. This is a significant advantage over prior art structures which were difficult to insert within the borehole because of projecting pieces of rock or slight bends along the length of the borehole. Rigid prior art tubes were incapable of bending around such projecting rock structures or bent formations of the borehole; whereas, the flexible structure of the present wand enables its insertion around such corners and within difficult configurations.

The embodiment of the wand illustrated in FIG. 2 includes an additional valve element 33 which permits the use of specific liquid explosives which have low viscosity to facilitate rapid pumping, yet which respond to the effects of this element 33 to greatly enhance viscosity after passing therethrough. This property is favorable becvause it permits rapid flow of the liquid explosive through the pump, conduit and wand, while converting the material to a high viscosity substance which is capable of retaining its loaded position within the borehole.

An example of such a device is disclosed in U.S. Pat. No. 4,615,752. This invention provides a valve structure which imparts shear to the explosive composition to thereby increase its viscosity prior to expulsion from the distal end 34 of the wand. This allows the emulsion slurry to be easily punmped at a relatively low viscosity but to be delivered into a borehole at the desired higher viscosity so that the explosive is retained in its loaded position. As is shown in FIG. 2, this explosive material 36 fills the borehole volume along its length, conforming to the jagged wall structure sufficiently, in some instances, to restrain the explosive from sliding free, even with the wand 30 removed after the loading operation has been completed. The advantages of utilizing element 33 to enhance viscosity will be apparent to those skilled in the mining industry. As was previously mentioned, fitting 22 at the terminal end 14 of the tube is provided for attachment of the subject valve element 33.

A primary point of invention previously mentioned is the combination of parallel reinforcement cords 12 within the flexible, elastic composition of tube 11. Such parallel cords preclude elongation along the axis 13, but allow the elastic material to stretch sufficient to enlarge the radius of tube in response to a radial force 37. This radial force 37 is developed by the combination of back pressure arising from valve element 33 as it impedes flow of the explosive material free of the wand. The resulting back pressure within the wand 30 causes the tube 11 to expand radially, increasing the outer diameter thereof. This radial elongation is represented by the phantom lines 38 shown in FIG. 1. The amount of elongation will depend upon the inner radius of the borehole and the capacity of the elastic material within tube 11 to stretch and fill that borehole radius.

The advantage of the valve illustrated in U.S. Pat. No. 4,615,752 with the present system is that back pressure is developed by a valve having an orifice with an opening smaller in cross section than the inner diameter of the tube when in its non-elongated state. This structure enables imposition of a shear to a composition passing therethrough, resulting in a desired increased viscosity. Other means for increasing viscosity will be apparent to thsoe skilled in the art and will be applicable to the present invention, particularly where increased back pressure arises within the wand.

Depending upon the type of composition and its degree of elongation in response to a given radial force, the following guideline for tube outer diameter with respect to borehole inner diameter is useful. Generally, the ratio of outer tube diameter in a non-elongated state to borehole inner diameter is approximately three to three and one-half (3:3½). This provides an approximate radius distance of one-quarter inch or six millimeters of expansion distance between the outer wall of the wand and the inner wall of the borehole. If a substantially greater distance is provided because the wand is too narrow within the borehole opening, it is difficult to obtain an effective seal upon inflation of the wand by reason of back pressure of the liquid explosive.

Other guidelines for dimensions include tube outer diameters which extend from one-half inch or 1.3 centimeters to less than five inches or 12.7 centimeters, and a length of at least 12 inches or 30 centimeters. This is not to say, however, that longer lengths cannot be used, even extending up to four or five feet. The preferred dimensions with respect to a borehole of conventional length and with an inner diameter of three and one-half inches or 8.9 centimeters is three feet in length and three inches in outer diameter for the wand. For wands having an outer diameter of at least two inches, wand length should be least two feet to provide appropriate rate of fill of explosive material and desired support below the load of explosive.

Use of the subject invention is represented by the following steps of application. First, the inflatable wand is attached to an end of a supply conduit for carrying the explosive material to the borehole. The wand is then inserted into a collar portion of the borehole so that at least two-thirds of the wand is contained within the borehole interior. This is desirable so that the wand does not migrate upon inflation out of the contained volume of the borehole. Furthermore, failure to insert most of the wand structure within the borehole may result in excessive enlargement of the unrestrained portion of the wand and possible rupture based on a ballooning effect.

The explosive material is then pumped into the wand to enlarge the wand in a radial direction until an outer covering of the wand contacts an inner wall of the borehole. At the same time, the longitudinal cord reinforcement restrains the wand against axial elongation and prevents damage or destruction to the wand wall structure. The explosive is then fed on a continuous basis through the wand and into the borehole until the loading has been completed. By attaching a flow control device such as has been previously referred to under U.S. Pat. No. 4,615,752, back pressure can be developed within the wand while the viscosity of the explosive material is concurrently increased.

Figure 3:
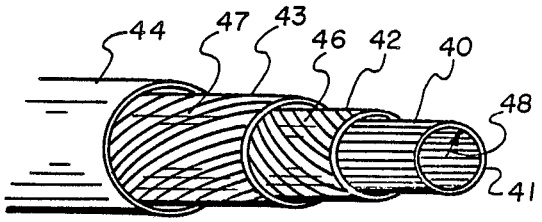
FIG. 3 is an additional embodiment of an inflatable wand in accordance with the present invention.

It will be apparent to those skilled in the art that this method can be practiced utilizing other embodiments of the present invention than those specifically disclosed in FIGS. 1 and 2. For example, FIG. 3 illustrates a second embodiment wherein bias ply reinforcement is overlaid on the basic tube structure. This alternative embodiment comprises an inner tube 40 whose construction corresponds to that of tube 11 but of lesser thickness. Overlaying structures 42, 43 and 44 are shown in cutaway view; however, these structures actually extend to terminal 41, which corresponds to the first end described in FIG. 1. This overlay construction is provided to impose a uniform restraint with respect to radial elongation of the contained tube 41. This is accomplished by providing opposing bias plies 42 and 43 along the length of the tube in approximate equal, offset orientation. For example, the reinforcing cord 46 of bias ply 42 may be oriented in a spiral or a helical manner about the central axis of the tube and with helix angles of a least 80 degrees. Conversely, the reinforcing cord 47 of overlay 43 would conprise a spiral or helical orientation fiber having the opposing, corresponding negative helix angles of at least −80 degrees.

Such opposing bias ply operates to restrain the amount of elongation in the radial direction 48 to thereby control the amount of extension of the wand within the borehole. By using two overlays of opposing bias orientation, the radial elongation along the tube remains uniform and balanced. Again, a final elastic covering 44 can be provided to protect the reinforcing fibers 46 and 47 from adverse tearing of the borehole walls.

Figure 4:
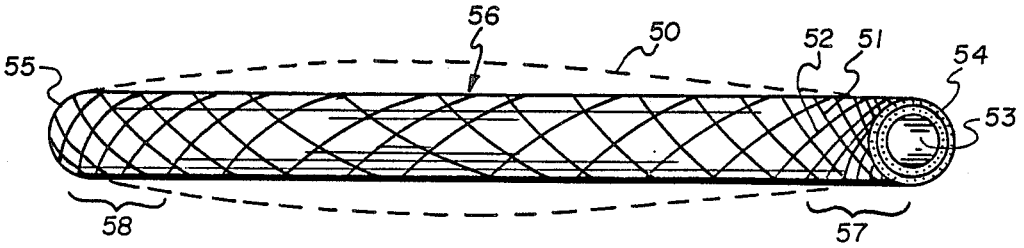
FIG. 4 shows a further embodiment of an inflatable wand having a variable form of restraint in the terminal sections.

Whereas the example of FIG. 3 provides for uniform restraint against radial elongation, FIG. 4 illustrates a construction which imposes a variable restraint, resulting in a tapered structure as illustrated by the phantom lines 50 in FIG. 4. This example illustrates the general use of reinforcing fibers 51 and 52 in cross orientation with the axially-oriented fiber reinforcement 53. Whereas the axially-oriented fiber 53 extends the full length of the tube, the cross fibers 51 and 52 vary in density along the tube length. This provides a decreasing resistance from the terminal ends 54 and 55 toward the intermediate section, shown generally as 56.

This form of variable restraint can be accomplished by the use of either increased bias angles with respect to the longitudinal fiber, by increased density of reinforcing fiber at terminal sections 57 and 58, or by combination of both factors. The overall effect of the adjusted orientations and densities of reinforcing fiber is to permit tailoring of the enlargement of the wand as shown by the tapered structure 50 shown in broken lines.

Generally, this tapered configuration is characterized by a graduated decrease in resistance against radial elongation from the larger diameter of the intermediate section to the narrower diameters at the terminal sections, which have become common with the diameters of the ends of the tube 54 and 55.

This tapered enlargement may have advantages over the uniform enlargement in certain types of boreholes particularly where the wand is to be withdrawn from the borehole following loading of explosive.

Here again, it will be apparent to those skilled in the art that variations with respect to the illustrated reinforcements shown in FIGS. 3 and 4 can be readily envisioned. It is therefore to be understood that the examples set forth in this disclosure are for illustration purposes and should not be construed to limit the scope of the invention as defined in the following claims.

I claim:

1. An inflatable wand for positioning within a mining borehole and near a lower collar opening thereof wherein the wand provides a conduit for introducing and retaining liquid explosive material within the borehole, said wand including:

a tube having a first end and adjacent first terminal section, a second end and adjacent second terminal section, and an intermediate section therebetween, said tube being capable of limited radial elongation in response to a force directed radially outward from within the tube, but including means for restraining the tube against axial elongation during use, said tube having a non-elongated outer diameter less than the inner diameter of the borehole;

means for applying a force directed radially outward from within the tube; and means for attaching a delivery conduit to the first end of the tube to enable supply of the explosive material.

2. An inflatable wand as defined in claim 1, wherein the tube includes means coupled to at least one of the first and second terminal sections to impose a variable restraint with respect to radial elongation and wherein the radial elongation is lesser at the tube end and gradually increases toward the intermediate section, thereby providing for decreasing radial elongation along the terminal section toward the adjacent tube end to form a tapering configuration of the terminal section with respect to the intermediate section during use.

3. An inflatable wand as defined in claim 1, wherein the tube includes means coupled to the first and second terminal sections to impose a variable restraint with respect to radial elongation and wherein the restraint is greater at each tube end and gradually decreases toward the intermediate section, thereby providing for decreasing radial elongation progressively along the terminal sections from the intermediate section toward the respective tube ends to form a tapering configuration of the terminal sections with respect to the intermediate section during use.

4. An inflatable wand as defined in claim 1, further comprising means coupled at the second end of the tube to impose a back pressure on the explosive material passing through the tube, said tube being comprised of an elastic composition which develops the described radial elongation in response to the back pressure.

5. An inflatable wand as defined in claim 4, wherein the means for developing back pressure comprises a valve having an orifice with an opening smaller in cross-section than the inner diameter of the tube when in a non-elongated state.

6. An inflatable wand as defined in claim 5, wherein the valve includes means for imposing shear to the composition passing therethrough, thereby increasing viscosity of the composition and raising back pressure to cause radial elongation of the tube.

7. An inflatable wand as defined in claim 1, wherein the means for restraining against axial elongation of the tube includes embedded, non-elastic fibers within the tube wall oriented axially to restrain elongation in the axial direction, yet permitting limited radial elongation.

8. An inflatable wand as defined in claim 1, wherein the tube includes fiber reinforcement within the tube structure, said fiber reinforcement having an axial orientation to permit radial elongation while preventing axial elongation.

9. An inflatable wand as defined in claim 8, further comprising transverse reinforcing fibers cross oriented with the axially oriented fiber reinforcement and being disposed within the terminal sections of the tube as a bias ply, said cross fibers being oriented with respect to the axially oriented fibers to resist radial elongation at the tube ends, and provide a decreasing resistance against such radial elongation progressively toward the intermediate section.

10. An inflatable wand as defined in claim 9, wherein the tube is reinforced with a decreasing density of cross fibers from the terminal ends toward the junction of the terminal sections and intermediate section, thereby developing a graduated decrease in resistance against radial elongation which adapts the tube to respond with tapered terminal sections during use.

11. An inflatable wand as defined in claim 2, wherein the means for imposing variable restraint with respect to radial elongation of the terminal sections of the tube comprises reinforcing fibers within the tube structure which form a bias ply of fibers positioned to develop a tapered response to radial pressure arising from enclosed explosive material under pressure, said taper converging from a common diameter with the intermediate section to a smaller diameter common with the ends of the tube.

12. An inflatable wand as defined in claim 1, further comprising reinforcing fibers within the tube wall in helical orientation with respect the axis.

13. An inflatable wand as defined in claim 12, wherein the helical orientation of fibers includes a first set of fibers oriented with a positive helix angle and a second set of fibers with a negative helix angle, said angles being approximately equal at corresponding axial positions along the wand.

14. An inflatable wand as defined in claim 13, wherein said helix angles are at least +80 degrees and −80 degrees.

15. An inflatable wand as defined in claim 1, further comprising reinforcing fibers within the tube in a spiral orientation along the length of the tube in a spiral orientation to provide a partial restraint against radial elongation.

16. An inflatable wand as defined in claim 1, wherein the tube includes multiple reinforcing fibers in angularly opposing but substantially equal spiral orientations at common axial positions along the wand.

17. An inflatable wand as defined in claim 1, further comprising a threaded end coupled to the first end for enabling attachment to a conduit for delivery of explosive material, said second end also including a threaded end for attachment of a valve device for controlling outflow of material.

18. An inflatable wand as defined in claim 1, wherein the tube is composed of multiple layers of alternating rubber and reinforced rubber.

19. An inflatable wand as defined in claim 1, wherein the tube is greater than ½ inch and less than five inches in outer diameter and is at least twelve inches in length.

20. An inflatable wand as defined in claim 19, wherein the tube has an inner diameter of at least one and one-half inches and a length of at least two feet.

21. An inflatable wand as defined in claim 19, wherein the ratio of outer tube diameter in a non-elongated state to borehole diameter is approximately 3 to 3½.

22. A method for filling an upward oriented mining borehole with a liquid explosive material, said method comprising the steps of:

(a) attaching an inflatable wand to an end of a supply conduit for carrying the explosive material to the borehole;

(b) inserting the wand into a collar portion of the borehole such that at least two thirds of the wand is contained within the borehole;

(c) causing the wand to enlarge in a radial direction until an outer cover of the wand contacts an inner wall of the borehole, while at the same time restraining the wand against axial elongation;

(d) feeding the explosive mixture through the wand and into the borehole until the hole is sufficiently filled.

23. A method as defined in claim 22, further comprising the step of attaching a flow control device at the filling end of the wand to create back pressure by reason of impeded flow of the mixture through the valve, said back pressure providing sufficient force to enlarge the wand in the radial direction.

* * * * *